United States Patent [19]

Heran et al.

[11] Patent Number: 4,649,834

[45] Date of Patent: Mar. 17, 1987

[54] TEMPERATURE CONTROL SYSTEM FOR PYROLYSIS FURNACE

[75] Inventors: Robert F. Heran, Westlake; Robert A. Koptis, Brookpark, both of Ohio

[73] Assignee: Armature Coil Equipment, Inc., Cleveland, Ohio

[21] Appl. No.: 822,022

[22] Filed: Jan. 27, 1986

[51] Int. Cl.[4] ..... F23N 5/02

[52] U.S. Cl. ..... 110/190; 110/193; 110/210; 110/215; 110/236; 432/37; 432/72

[58] Field of Search ..... 110/185, 186, 187, 188, 110/190, 193, 210, 211, 215, 236; 432/37, 72

[56] References Cited

U.S. PATENT DOCUMENTS

| | | | |
|---|---|---|---|
| 3,705,711 | 12/1972 | Seelandt et al. | 110/236 X |
| 3,767,179 | 10/1973 | Larson | 432/42 |
| 3,839,086 | 10/1974 | Larson | 432/85 X |
| 4,013,023 | 3/1977 | Lombana et al. | 110/187 |
| 4,145,979 | 3/1979 | Lilley et al. | 110/210 |
| 4,270,898 | 6/1981 | Kelly | 432/37 X |
| 4,557,203 | 12/1985 | Mainord | 110/193 X |

*Primary Examiner*—Albert J. Makay
*Assistant Examiner*—Steven E. Warner
*Attorney, Agent, or Firm*—Alfred D. Lobo

[57] ABSTRACT

A batch-type pyrolysis furnace fired by a main gas burner and an afterburner, is effectively safeguarded from explosions and runaway fires due to an undue build-up of flammable vapors within its main chamber, by the simple expedient of maintaining a fire under controlled temperature conditions in the main chamber. This is done by a dual-stage control system requiring three thermocouples, one (first) in the main chamber, a second in the exhaust stack downstream of the afterburner, and a third upstream of the afterburner in the vent passage ("throat") connecting the main chamber with the afterburner chamber. The first thermocouple in the main chamber senses the ambient, essentially instantaneous temperature at that location. The effectiveness of the control system, in large measure, derives from the unexpected difference in temperatures sensed by the first and third thermocouples.

4 Claims, 4 Drawing Figures

TEMPERATURE CONTROL SYSTEM FOR PYROLYSIS FURNACE

BACKGROUND OF THE INVENTION

This invention relates to a control system for a pyrolysis device of the type used for volatilizing and burning organic material from a metal part to which the organic material is bonded. Incineration occurs in a zone adjacent to the device's main chamber in which the material is volatilized, resulting in innocuous products of combustion which may be discharged into the atmosphere. Such an incineration zone is typically provided by an afterburner chamber in which an afterburner, positioned downstream of the device's main chamber in which pyrolysis occurs, burns the volatilized organic material (referred to herein as "vapor"). The remaining metal part is reclaimed for reuse because the cost of reclamation is less than that of making the metal part anew. Such reclamation by pyrolysis has evolved into a subindustry of considerable economic significance not only because pyrolysis is cost-effective, but because incineration of the vapor of polymeric materials which are not economically recyclable, conveniently and beneficially disposes of them.

The vapor to be incinerated is generated when mounting means for engines and electric motors (collectively referred to as "motor mounts"), and similar steel parts bonded to rubber; or, copper-containing electrical parts such as armatures, stators, transformers and the like; or, painted ferrous or non-ferrous steel parts; or, metallic bodies of arbitrary shape which are coated with, or bonded to polymeric materials (referred to herein as "polymer-bonded metal parts"), are to be pyrolized in a pyrolysis furnace.

Polymeric materials to be disassociated from metal parts are such materials as are commonly bonded to a metal substrate or matrix and include natural and synthetic elastomers; for example, natural rubber and synthetic rubber which are polymers of dienes; silicones which are polymers of siloxanes and the like; and, natural and synthetic resinous materials including natural shellac and synthetic plastics such as phenolics and acrylics, particularly paints.

The foregoing polymeric materials are to be separated from the metal matrix to which they are bonded without melting the metal, and preferably, in most instances, without causing warpage or other undesirable deformation of residual metal matrix. It is self-evident that such separation may be effected by directly incinerating the polymeric materials, as is typically done in an incinerator for waste, but it is equally self-evident that the requirement of incineration without damaging the metal parts will not be met. Of course, damage to the parts can be minimized if only a few parts are incinerated together, but this method is undesirable because it does not lend itself to reclaiming a large enough mass of parts to be economical.

The term "pyrolysis oven" has been used in the art to indicate that there is no incineration of organic material on the metal parts within the oven's main chamber. The material is simply volatilized (or vaporized) without being burned in the oven's main chamber. The vapors are then burned in the afterburner chamber. Such operation of a "pyrolysis oven", where there is no fire in the main chamber, is supposed to clearly distinguish its function, from that of a "pyrolysis furnace" in which there is. Nevertheless, the terms are often misused or interchanged, particularly in relation to devices using an afterburner in an afterburner chamber of the furnace, with no thought given as to the significance of where the fire is maintained. This invention is specifically directed to a pyrolysis furnace with an afterburner chamber in which furnace a fire is sustained in the furnace's main chamber, under controlled temperature conditions, such that an explosion does not occur. A charge of metal parts on a cart is charged to the main chamber, the charge is brought up to ignition temperature, ignited, and the fire sustained under controlled conditions until the charge is burned out.

It is known that heating of the metal parts to 700°–800° F. in an enclosure with limited air intake will char or degrade all known combustible contaminants without ignition if the percentage of contaminants is less than about 2% by weight ("wt") of the parts, but we are concerned with higher amounts of combustibles in the range from 2% to about 40% by wt. To the extent that our pyrolysis furnace is used to reclaim metal parts associated with a minor proportion by wt of polymers, it is unlike a typical incinerator in which a major proportion by wt of the load is consumed by incineration.

In pyrolysis ovens belonging to the class including a main burner and an afterburner, it is desirable to process a large mass of metal parts with the concomitant generation of a large volume of combustible vapor. This requires that one avoid a fire in the main chamber, and that the amount of vapor be generated at a controlled rate so that it can be incinerated in the afterburner chamber without triggering an explosion.

Since in either an oven or a furnace, the hot air to vaporize the organic material is generated by a natural gas, LP gas or oil-fed burner (referred to as the "main burner") with a shielded flame, there is always a high probability that if the material is vaporized too fast to be incinerated in the afterburner, the vapors will ignite and cause an explosion in the main chamber. It is such an explosion which must be avoided. To do so, that is avoid the explosion, the obvious thing to do is to avoid an igniting spark or fire in the main chamber. We do not do so. By sustaining a fire in the main chamber, it was hoped we would only have to contend with excessive temperature, due to the burning of too much vapor. Since ignition had already occurred, an explosion seemed most unlikely. But the explosions occurred. We were unable to prevent them. The precise mechanism of the explosion and the criticality of vapor build-up is not understood, but we have found that, even while deliberately sustaining a fire in the main chamber, we can still set off an explosion if a critical build-up of vapor is exceeded.

It is unnecessary to point out that, when operating under near-explosive conditions, a very small misstep can set off the explosion, and any control system which prevents such an explosion from being set off acquires great merit.

Numerous control systems have been used in the past to attempt to ensure the safe operation of furnaces and dryers in which flammable volatiles are generated. One of the methods of preventing a fire or explosion within the main chamber is to equip it with water nozzles which are actuated by a temperature sensing means situated so as to sense the temperature within the main chamber, and when a preset temperature is exceeded, a signal is generated which results in spraying water onto the mass being burned, to help put out the fire and cool the mass.

For example, U.S. Pat. Nos. 3,767,179 and 3,839,086 to Larson teach a control system for a rotating drum dryer for metal scrap contaminated with flammable oil. Sufficient oil is evaporated to bring about at least partial combustion of the oil and maintain a self-supporting flame. The dryer is provided with a bank of water-injection nozzles within the dryer which are individually controlled by cam-actuated metering valves, to inject varying amounts of water into the dryer depending upon the temperature within it. A signal generated by a thermocouple situated within an exhaust gas stream from the dryer, determines the number of nozzles which are simultaneously activated in order to avoid oxidizing, fusing or even melting of the scrap. Since partial combustion is maintained, problems of varying severity within the dryer are quenched proportionately, at the same time avoiding an explosion.

A reclamation oven with a control system for preventing fires and explosions and thus controlling excess temperature within it, is disclosed in U.S. Pat. No. 4,270,898. The fire and explosion control method senses a fire situation before it occurs, and keeps the fire from happening by instituting a timely extinguishing system. A thermocouple is installed in the exhaust, downstream from the afterburner, and when the temperature exceeds a preset temperature, a signal from the thermocouple actuates an automatic valve assembly to open it and spray water onto the too-hot parts in the main chamber. When the parts cool sufficiently, the valve assembly closes. The system prevents fires and explosions and thus controls excess temperatures. The main burner is not shut off when the water spray comes on, though the main burner goes off when the oven reaches the set-point temperature, nor is the average temperature above the metal parts in the oven's main chamber (referred to as the "ambient temperature" in the main chamber) monitored. The prior art system in which a fire in the main chamber is prevented, is quite unlike our system in which a fire is maintained under conditions imposed by controlling temperature, so that an explosion is obviated.

Another system relating to incineration of unwanted organic material such as oil associated with metal parts, particularly scrap or swarf, is disclosed in U.S. Pat. No. 3,705,711 to Seelandt et al. Only as much air and fuel as is required to fuel the main burner, is burned to minimize oxidation of the metal parts and to minimize the risk of explosion. Control is provided by limiting the amount of combustion air to the main chamber when a preset pressure is exceeded. It is suggested that the temperature within the drum may first be lowered by throttling back the main oil burner or by stopping the feeding of metal scrap into the dryer drum. When the main burner output is reduced to its lower limit and the temperature within the drum is still too high, a water spray may be actuated. Should the spray be insufficient to lower the temperature, the feeding of the scrap into the drum is reduced or stopped. The problem is that the time period required for these operations is much longer than that permitted by conditions under which an explosion occurs because of ignition of the built-up vapor. As a result, such a system is wholly unsatisfactory under the conditions of operation of a pyrolysis furnace.

The control system of our invention is a two-stage system which, in the first step, shuts off the main burner with a signal from a first thermocouple in the exhaust gas stream downstream of the afterburner; if necessary, in the second step, either one of a second or a third thermocouple located upstream of the afterburner, determines whether the water spray is to be actuated. If sufficient cooling of the gases in the main chamber occurs without actuating the water spray, there is a substantial savings in fuel costs. Shutting off the main burner avoids the use of water to cool the parts which are at the same time being heated by a burner which is not shut off. The efficacy of our system is predicated on the discovery that there is a significant difference in temperature between the ambient temperature in the main chamber and the temperature of the gas stream in the throat of the main chamber just prior to entering the afterburner. It was always known that there is a large difference in temperature between those in the main chamber and the exhaust stack downstream of the afterburner.

SUMMARY OF THE INVENTION

It has been discovered that a batch-type pyrolysis furnace fired by a main gas burner and an afterburner, is effectively safeguarded from explosions and runaway fires due to an undue build-up of flammable vapors within its main chamber, by the simple expedient of maintaining a fire under controlled temperature conditions in the main chamber. This is done by a dual-stage control system requiring three thermocouples, one (first) in the main chamber, a second in the exhaust stack downstream of the afterburner, and a third upstream of the afterburner in the vent passage ("throat") connecting the main chamber with the afterburner chamber. The first thermocouple in the main chamber senses the ambient, essentially instantaneous temperature at that location. The effectiveness of the control system, in large measure, derives from the unexpected difference in temperatures sensed by the first and third thermocouples.

It is therefore a general object of this invention to provide, an improved pyrolysis furnace having a main chamber, a main gas burner directly to heat air ducted into the chamber, a throat near the top of the main chamber through which throat organic vapor volatilized by pyrolysis of polymer-bonded metal parts leaves the main chamber, an afterburner chamber provided with an afterburner to incinerate said organic vapor downstream of the throat, and, an exhaust stack through which incinerated vapor is vented, which furnace includes, a first temperature sensing means, located within the main chamber, near the top thereof, to sense the instantaneous ambient temperature of gases above the metal parts therewithin; a second temperature sensing means, located in the exhaust stack downstream of said afterburner;

a third temperature sensing means, located in said throat upstream of said afterburner; and, water spray means responsive only to said first and/or third temperature sensing means when either the temperature in the main chamber exceeds a predetermined critical ambient temperature in the range from about 600°–900° F., or a temperature in the range from about 700° F. to 1100° F. in the throat is exceeded, so that water is sprayed into a zone above said metal parts in said main chamber to lower the ambient temperature below said critical ambient temperature.

It is a specific object of this invention to provide a pyrolysis furnace in which an explosion in the furnace's main chamber is obviated by maintaining a fire in a charge of polymer-bonded metal parts being pyrolized under controlled temperature conditions provided by (i) sensing the stack temperature in the stack downstream of the afterburner, which stack temperature, if exceeded, shuts off the main gas burner, (ii) sensing the throat temperature of the gases in the throat of the main chamber upstream of the afterburner, and (iii) sensing the ambient temperature in the main chamber before the gases are burned in the afterburner, so that, if either the throat temperature or the ambient temperature is exceeded, a water spray is actuated to cool the burning charge.

It is another specific object of this invention to provide a batch pyrolysis furnace with a two-stage safety system predicated upon the simultaneous operation of three thermocouples placed in preselected locations (i) in the main chamber, (ii) in the exhaust stack downstream of the afterburner, and (iii) in the throat; and, control means including one actuated by said thermocouple in the exhaust stack which only attenuates or shuts off the main burner, and others which either selectively or simultaneously actuate an ON-OFF switch controlling the main burner, and a water spray.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the views and in which.

DETAILED DESCRIPTION OF PREFERRED EMBODIMENTS

Figure 1:
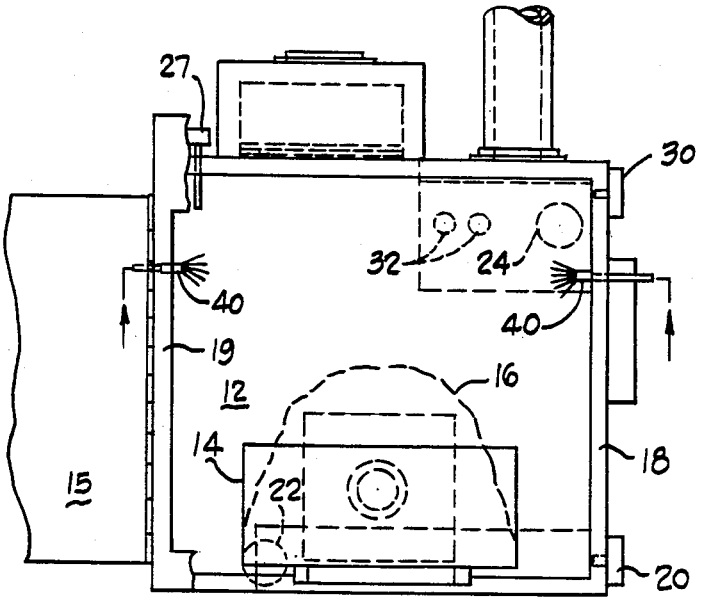
FIG. 1 is a front elevational view of a schematically illustrated pyrolysis furnace, with an open front door shown broken away, the operation of which furnace is controlled by the two-stage temperature control system of this invention.

The most preferred embodiment of the invention is diagrammatically illustrated in FIG. 1 which is a front elevational view of a pyrolysis furnace, indicated generally by reference numeral 10, which is typically a large structure shaped like a rectangular parallelpiped though the shape is not especially relevant to the function of the furnace. Within the furnace is a main chamber 12 onto the floor 13 of which a cart 14 is rolled through a door 15. The cart is loaded with polymer-bonded metal parts 16 to be pyrolized. The door 15, shown in the open position with a portion broken away, is in the front of the furnace which has a rear wall 17, right side wall 18 and left side wall 19. The door is gasketed with a suitable high temperature material to seal the main chamber during operation, and the interior surface of the door, like the interior of the main chamber, is insulated with ceramic fiber. After one charge is subjected to a pyrolysis or "burn-off" cycle, another is introduced into the chamber and the cycle is repeated, which is why the furnace is referred to as a "batch" pyrolysis furnace.

At the far end of the chamber from the door, and behind the rear wall, is provided a direct heating means for air in the form of a main burner assembly, indicated generally by reference numeral 20, which includes a main burner removably inserted in a main burner firebox 21, air regulating means (not shown) to adjust the air flow to the burner, and associated hardware (not specifically shown) all of which is conventional and commercially available. The particular type of direct heating means for supplying hot air is not critical so long as it can provide enough heat to ignite the polymer on the metal parts once they have been brought up to temperature in the main chamber. Most preferred is a main burner which burns natural gas fuel to produce an elongated flame which is adjusted to extend along substantially the entire length of the base of the rear wall 17 of the chamber. Hot combustion gases generated by the main burner flow into the main chamber through a burner passage 22 in rear wall 17. The burner passage 22, places the main chamber in open communication with the main burner firebox. The flame is adjusted to extend the length of the firebox with the tip of the flame playing at passage 22, the cross-sectional area of which is substantially the same as that of the sheath so that there is no significant restriction of circulation of the hot gases generated by the main burner. This ensures igniting the charge after it reaches ignition temperature.

The type of main burner chosen depends upon the size of the charge and chemical composition of the polymer to be "burned", and the time constraints for doing so. For a typical main chamber having a width of 4 ft., a length of 4 ft., and a height of 4 ft., within which a charge of about 500 lb of motor mounts are to be burned, an Adams Model 225 burner having a rated output of 100,000 BTU/hr is used. This burner may be adjusted to throw a flame about 3 ft long, and the air intake to the burner can be controlled to ensure that the fuel burns with an excess of oxygen.

In the rear wall 17, and near the top thereof, diagonally from the burner passage 22, is a throat 24 through which hot gases generated in the main chamber leave it. The throat 24 places the main chamber 12 in open communication with an afterburner chamber 26 in which an afterburner assembly 30 is removably inserted. The assembly 30 includes an afterburner, means for regulating the amount of natural gas burned, means for regulating the air flow to the burner, and associated hardware (not specifically shown) all of which are commercially available, for example in an Adams HP BPS burner (output 400,000 BTU/hr) assembly. The afterburner is adjusted to throw an elongated flame. All gases which leave the main chamber must flow through the throat 24 and come in contact with the afterburner flame in the afterburner chamber.

The diameter of the throat 24 is sized so as to provide a predetermined draft, whether natural or forced, in the main chamber during operation of the furnace. The type of polymer burned, the weight of polymer present on each charge, the volume of the main chamber, and the time in which each cycle is to be completed (that is, the charge is to be introduced, brought up to temperature, burned and cooled enough to withdraw the cart from the main chamber), inter alia, will determine the area.

In particular, when the mass flow rate of hot gases and vapor through the throat 24 exceeds a critical venting flow rate there is a rapid build-up of pressure, which build-up, if continued, results in an explosion. To avoid the explosion, the quantity "(area of the throat 24)/(volume of the main chamber 12)" must exceed 0.005/ft. and preferably not exceed 0.015/ft. This quantity is referred to as the critical vent number.

For example, a furnace with a 4'(ft)×4'×4' main chamber required to burn a charge of about 500 lb of paint racks coated with about 50 lb of paint in a 4 hr cycle, requires a vent larger than 0.5 ft in diameter. The vent is too large when a desirable draft to ensure good flow through the stack cannot be maintained. An operable vent diameter is in the range from 8" (inches) to 10".

The afterburner chamber is provided with adjustable auxiliary air vents 32 through which fresh air is introduced to supply the necessary oxygen for complete combustion of the vapor flowing through the flame of the afterburner. The combustion gases from the afterburner chamber 26 flow upwardly through a stack 34 and are vented to the atmosphere.

As already pointed out, our system relies on sustaining a fire under controlled conditions in the main chamber so as not to trigger an explosion. However, to complete a "burn" of the charge within a few hours, usually from 4 to 6 hr, and generally no more than 8 hr, each cycle is completed within a period close to the minimum. Under such conditions the risk of an explosion is increased. Accordingly, as a precautionary measure, the furnace 10 is provided with an explosion control escape hatch 35 shown in phantom outline in an open position, and an escape hatch enclosure 36 which is vented to the atmosphere through a stack (not shown).

Under such conditions, we discovered that there is a surprising difference in the ambient temperature in the main chamber and that in the throat 24; and, though neither one of these alone can control the operation of the furnace in combination with the stack temperature, the three together can effectively do so.

Figure 2:
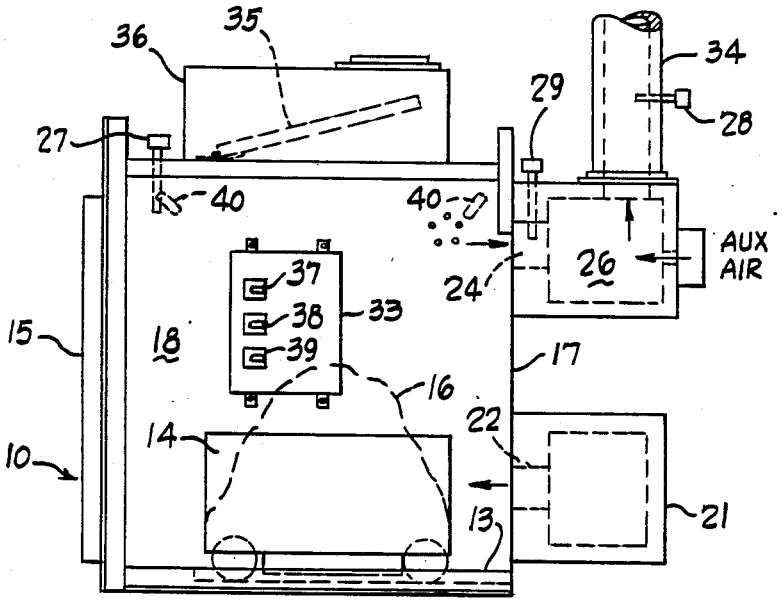
FIG. 2 is a side elevational view of the furnace showing the preferred locations in the furnace of the three thermocouples essential to the effective operation of the furnace with the control system.

Since we know of no single criterion for anticipating when an explosion will occur during a cycle, it is essential to provide three thermocouples at three different locations which simultaneously sense the temperatures at each location. As seen more clearly in FIG. 2, a first thermocouple 27 (T/C-1) is placed in the main chamber near its ceiling; a second thermocouple 28 (T/C-2) is placed in the stack just downstream of the afterburner chamber 26; and, a third thermocouple 29 (T/C-3) is placed in the throat 24 just upstream of the afterburner. The thermocouples transmit signals to plural control means 37, 38 and 39 mounted on an electrical panel 33 wall, shown mounted on the right side wall 18, so as to control the burn-out of a charge as described hereinafter.

By controlling only the temperatures, sensed by each of the three thermocouples we are able to monitor, essentially instantaneously, the mass flow of vapor and combustion gases through the throat. When any temperature sensed by any of the three exceeds its predetermined temperature, an appropriate reduction in heat input to the main chamber is made, optionally in conjunction with immediately lowering the ambient temperature by the use of a water spray which is sprayed through nozzles 40 disposed within the main chamber, near the top thereof.

More specifically, controlling the temperature is effected with plural control means actuated by the first, second and third temperature sensing means, including (i) a first control means 37, responsive to a first signal generated by said first thermocouple 27, to attenuate or shut off the main burner and activate the water spray means when a predetermined temperature in the main chamber is exceeded, (ii) a second control means 38, responsive to a second signal generated by the second thermocouple 28, to attenuate or shut off the main burner when a predetermined stack temperature is exceeded, and (iii) a third control means 39, responsive to the third thermocouple 29, to activate the water spray means when a predetermined throat temperature is exceeded.

For example, when the set-point for the second control means (stack temperature thermocouple) is set for 1600° F. and this is exceeded, the main burner is shut off. It is not essential that the burner be turned off (completely attenuated) if simply attenuating its output less completely by decreasing its fuel supply will lower the temperature.

If the foregoing set-point for stack temperature is not exceeded, but the ambient temperature (set for 850° F., say) is exceeded, the main burner is turned off. If the ambient temperature proceeds to climb and exceeds a second set-point (set for 900° F., say) on the first control means 37, the water spray is turned on.

The set-point for the third control means (throat thermocouple) is always set about 100° F. above the first set-point of the first control means which in turn is preferably set about 50° F. below its auxiliary (second) set-point. This difference between the set-point for the third control means, and, the first set-point for the first control means, shculd be at least 50° F. for effective operation of the furnace with commercially available controls. With the foregoing settings for first control means 37, the set-point for the third control means 39 is preferably 950° F., but not more than about 1100° F. If the temperature set for the third control means (throat thermocouple) is exceeded, the water spray is turned on. At any particular time in the cycle, any one, two or all preset temperatures may be exceeded.

Figure 3:
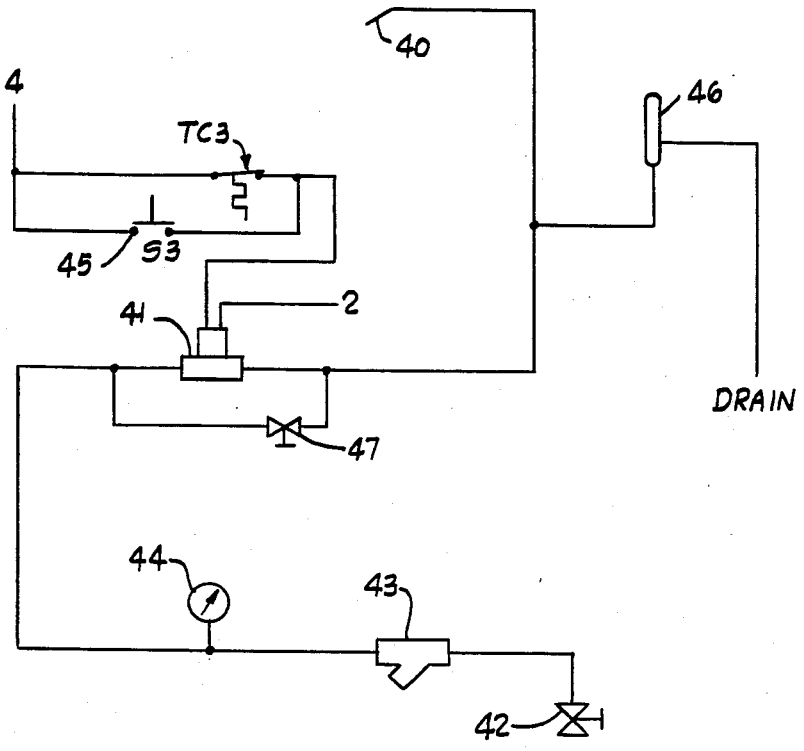
FIG. 3 is a diagrammatic illustration of a piping system for a water spray actuated by the control system for the furnace.

A simple water spray system is used in which the spray nozzles' combined output depends upon the size of the main chamber, the size of a normal charge to be burned, and the amount of polymer to be burned. Less than 1 gpm of water is typically adequate, from about 0.25–0.5 gpm being most preferred. The piping of the water system is schematically illustrated in FIG. 3 along with a portion of the electrical circuit for control of the solenoid 41.

Water from a water supply line under normal pressure of about 50 psig flows through gate valve 42 which is always open, then through strainer 43, and is stopped at the normally closed solenoid 41. A pressure gauge 44 senses line pressure. If the water pressure exceeds 175 psig it is relieved by a poppet type pressure relief valve 46. Upon signal from 27 (T/C-1) or 28 (T/C-3) the solenoid 41 opens and water is sprayed through the nozzles 40. When the temperature falls sufficiently, the water spray is stopped. The operation of the spray may be checked with a manual toggle switch 45 as will be explained in the description of the circuit diagram. A bypass valve 47, may be manually opened to bypass the electrically operated solenoid valve and provide a spray, if desired.

When the furnace is started, a relay in the burner is energized to start the blower motor. This closes the centrifugal switch on the motor and energizes the electronic ignition system. After a short delay, both the pilot valve and ignition are energized. Once the pilot is proven, the ignition is shut off and within one second the main valve opens. This is also the sequence when the main chamber temperature control calls for heat and the relay in the burner is energized to start the blower motor. The afterburner stays on high fire for the complete cycle. When the setpoint on the main burner temperature control is reached, the main burner goes off. The relay coil, main gas valve on the burner, and the pilot valve on the main burner are de-energized.

Figure 4:
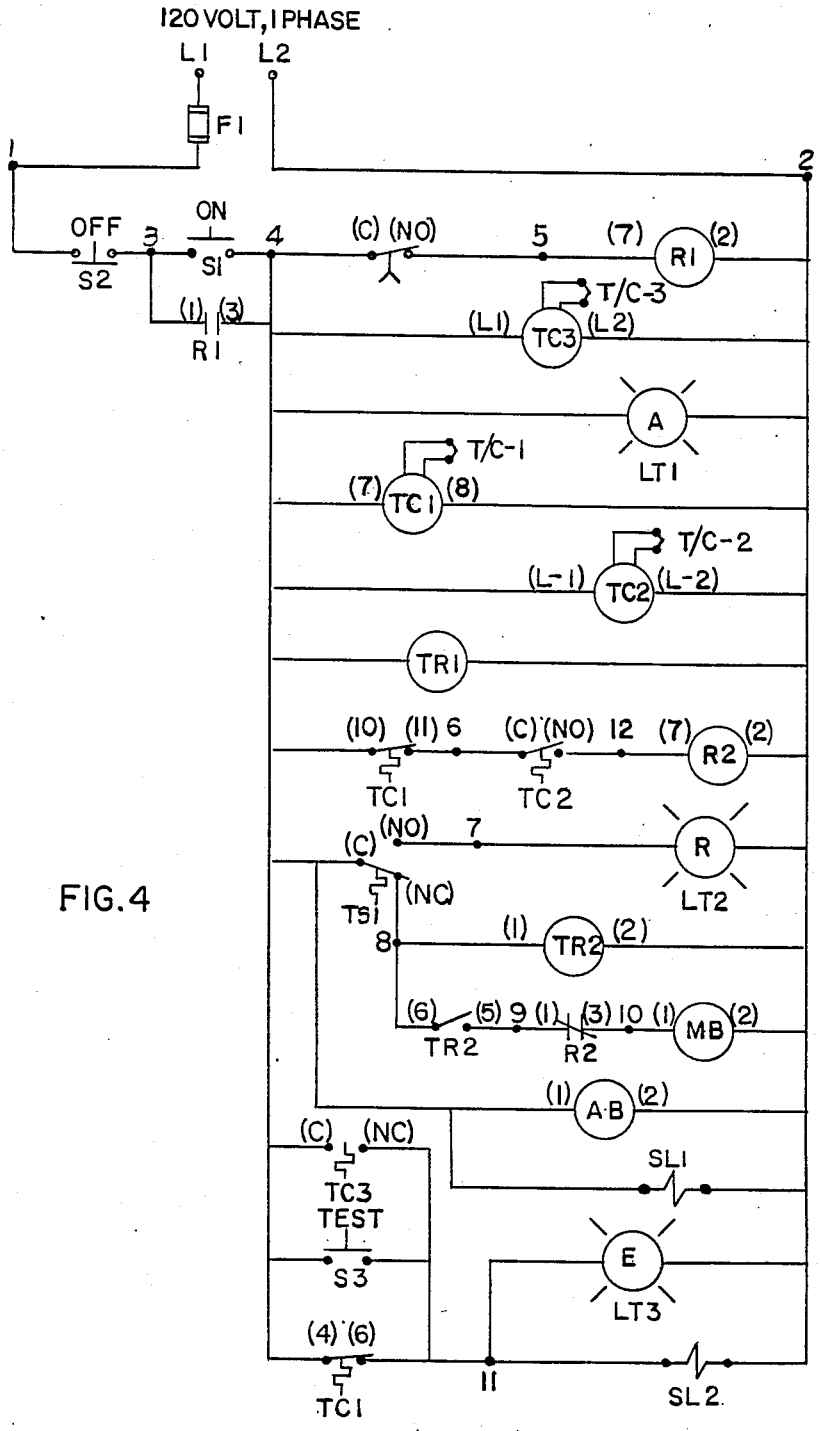
FIG. 4 is an electrical schematic for the control system.

Referring now to FIG. 4 there is shown a diagram for an electrical circuit for operation of the furnace with 120 volt (single phase) power supplied to terminals L1 and L2, the latter being neutral. Toggle switch S2 is normally closed. When switch S2 is opened, power to the rest of the circuit is cut off. Toggle switch S1 is normally open. When switch S1 is momentarily closed, power flows through contacts (C) and (NO) in the cycle timer TR1 and energizes the hold in relay coil R1 (7 & 2) so that the hold in contact R1 (1 & 3) is closed. This contact remains closed for the rest of the cycle and supplies power to terminal #4.

With power at #4 the electrical circuit is energized. The cycle timer motor TR1 is now operating and the temperature controllers TC1 (7 & 8), TC2 (L1 & L2), and TC3 (L1 & L2) have power supplied to them. The amber "power on" light LT1 will also come on at this time. The gas shut off solenoid SL1 will also be energized and actuate the gas valve (associated with the solenoid) to open it (the valve). The afterburner AB (1 & 2) will also be energized, go through its ignition sequence, and light up. The afterburner AB and gas solenoid SL1 will remain ON for the rest of the cycle.

As long as the furnace temperature remains below 1200° F., which is a preset temperature, power will flow through MB over-temperature control TS1 (C & NC). At this time the afterburner preheat timer motor TR2 (1 & 2) will start operating. When the 10 or 15 minute AB preheat cycle is over, AB preheat timer contacts TR2 (6 & 5) close. With this contact (TR2) closed, power is supplied to main burner relay contact R2 (1 & 3). When this contact R2 (1 & 3) is closed the main burner MB (1 & 2) will be energized, go through its ignition sequence, and light up. When contact R2 (1 & 3) is opened, the main burner MB (1 & 2) will be de-energized and go off.

When the furnace temperature exceeds 1200° F., MB over-temperature control TS1 contact (C & NC) will open and deenergize the main burner MB (1 & 2). Over-temperature control contact (C & NO) will close and the red high limit (over-temperature) light LT2 comes on. If, after having exceeded the preset temperature of 1200° F. the furnace temperature drops below 1200° F., MB over-temperature control TS1 must be manually reset. When switch TS1 is reset, contact (C & NO) opens and turns off the red over-temperature light LT2. Contact (C & NC) closes and supplies power to afterburner preheat timer TR2.

The main burner is controlled by the main burner temperature control TC1 (10 & 11) and the exhaust stack temperature control TC2 (C & NO). Thermocouple T/C-1 is located in the furnace's main chamber to measure ambient temperature. Thermocouple T/C-2 is located in the exhaust stack. When the temperatures in the main chamber and the exhaust stack are below a predetermined setpoint, power is supplied to the main burner relay coil R2 (7 & 2). When the relay coil R2 is energized, the main burner relay contact R2 (1 & 3) closes. If the temperature in the main chamber or exhaust stack exceeds the preset point, the main burner relay coil R2 (7 & 2) is de-energized and mainburner relay contact R2 (1 & 3) opens.

The water spray system is controlled by a toggle switch S3, main burner temperature control TC1 (4 & 6) and water spray temperature control TC3 (C & NC). Thermocouple T/C-3 is located in the throat 24. If the temperature in either the throat or the main chamber exceeds the preset points of TC1 (4 & 6) or TC3 (C & NC), the spray system solenoid will be energized, the blue light LT3 goes on and the water valve associated with the solenoid is opened. Water is sprayed in a mist (or, finely divided stream of droplets) until the temperature in the throat and that in the main chamber drops below the set point and the water solenoid is de-energized. Closing the contacts for switch S3 manually will also energize SL2 and turn on the blue light LT3.

At the end of the cycle, the cycle timer contacts TR1 (C & NO) will open and de-energize hold in relay coil R1 (7 & 2). When the hold in coil is de-energized, the hold in relay contacts Rl (1 & 3) will open. With this contact Rl open, there will be no power supplied to terminal #4 and the electrical circuit is de-energized. The furnace is shut off.

From the foregoing description of the best mode of operating the furnace it will be seen that avoiding an explosion is in large part predicated on sustaining a fire in the mass of parts in the main chamber; and the effectiveness of the control system is based on control of the mass flow of combustion gases and organic vapor from the main chamber by simultaneously controlling the temperatures at three different locations two of which, namely the temperature in the throat and that in the main chamber, were not known to be different during operation of the furnace. Because this difference was not known, the significance of this difference for the purpose of controlling the operation of a pyrolysis furnace was not appreciated.

We claim:

1. In a batch-type pyrolysis furnace having a main chamber, a main gas burner to directly heat air ducted into said chamber, a throat near the top of the main chamber through which throat organic vapor volatilized by pyrolysis of polymer-bonded metal parts leave the main chamber, an afterburner chamber provided with an afterburner to incinerate said organic vapor downstream of the throat, and, an exhaust stack through which incinerated vapor is vented, the improvement comprising, a first temperature sensing means, located within the main chamber, near the top thereof, to sense the instantaneous ambient temperature of gases above the metal parts therewithin;

a second temperature sensing means, located in the exhaust stack downstream of said afterburner operatively connected to said main burner for attenuated or on/off operation thereof;

a third temperature sensing means, located in said throat upstream of said afterburner said throat having an area, and said main chamber having a volume which are related such that their ratio is always greater than the critical vent number 0.005/ft.

water spray means responsive only to said first and/or third temperature sensing means when either the temperature in the main chamber exceeds a predetermined critical ambient temperature in the range from about 600°–900° F., or the temperature in the throat is at least about 50° F. higher than the ambient temperature, so that water is sprayed into a zone above said metal parts in said main chamber to lower the ambient temperature below said critical ambient temperature; and, plural control means actuated by said first, second and third temperature sensing means to control mass flow of combustion gases and organic vapor from the main chamber so as to avoid an explosion.

2. The pyrolysis furnace of claim 1 wherein said plural control means actuated by said first second and third temperature sensing means, include (i) a first control means, responsive to a first signal generated by said first temperature sensing means, to attenuate or shut off the main burner and activate said water spray means when a predetermined temperature in the main chamber is exceeded, (ii) a second control means, responsive to a second signal generated by said second temperature sensing means, to attenuate or shut off the main burner when a predetermined stack temperature is exceeded, and, (iii) a third control means responsive to said third temperature sensing means to activate said water spray means when a predetermined throat temperature is exceeded.

3. The pyrolysis furnace of claim 2 wherein said first control means includes two set points, a first about 50° F. lower than the second or auxiliary set-point, and said auxiliary set-point is not higher than 1100° F.

4. The pyrolysis furnace of claim 3 wherein, said water spray is in the form of finely divided droplets volume which are related such that their ratio is always which upon forming steam simultaneously lowers the temperature in the main chamber and increases the mass flow of vapor through said throat without triggering an explosion.

* * * * *